United States Patent [19]

Warwick

[11] 4,067,283

[45] Jan. 10, 1978

[54] BOAT MOORING DEVICE

[76] Inventor: Robert A. Warwick, 5128 Chalkpoint Road, West River, Md. 20881

[21] Appl. No.: 798,133

[22] Filed: May 18, 1977

Related U.S. Application Data

[63] Continuation-in-part of Ser. No. 654,982, Feb. 3, 1976, abandoned.

[51] Int. Cl.[2] ..... B63B 21/00

[52] U.S. Cl. ..... 114/230

[58] Field of Search ..... 114/230, 213, 214, 215, 114/253

[56] References Cited

U.S. PATENT DOCUMENTS

| | | | |
|---|---|---|---|
| 1,016,619 | 2/1912 | Froger | 114/253 |
| 2,871,813 | 2/1959 | Klawitter | 114/230 |
| 2,873,712 | 2/1959 | Gossen | 114/230 |
| 2,938,492 | 5/1960 | Kulick | 114/230 |
| 3,060,885 | 10/1962 | Nolf | 114/230 |
| 3,429,289 | 2/1969 | Lezak | 114/230 |

*Primary Examiner*—Trygve M. Blix
*Assistant Examiner*—Jesus D. Sotelo
*Attorney, Agent, or Firm*—Ulle C. Linton

[57] ABSTRACT

A boat mooring device for being detachably affixed to the side of a pile extending upright in the water and which device has a vertically moveable element attachable to a boat for retaining the boat to the pile, but riding up and down with the boat during changes of tide or waves.

7 Claims, 8 Drawing Figures

BOAT MOORING DEVICE

CROSS-REFERENCES TO RELATED INVENTIONS

The present application is a continuation-in-part of my copending application Ser. No. 654,982 filed Feb. 3, 1976 now abandoned.

Prior known related devices are shown in U.S. Pat. Nos. 2,440,972; 2,581,676; 2,808,016; 2,871,813; 2,873,712; 2,938,492; 2,990,803; 3,139,852; 3,196,824; 3,372,552; 3,430,600; and 3,463,114.

BRIEF SUMMARY OF THE INVENTION

The present invention is concerned with a device having a casing detachably affixed to a side of a piling and having an endless flexible member moveably supported by said casing for being capable of moving vertically with an eye on said endless member connectable to a boat whereby as the boat moves up and down with changes in the tide or waves, the eye will move therewith retaining the boat connected to the piling.

BRIEF DESCRIPTION OF THE VIEWS OF THE DRAWING

In the accompanying drawings.

DETAILED DESCRIPTION

Figure 1:
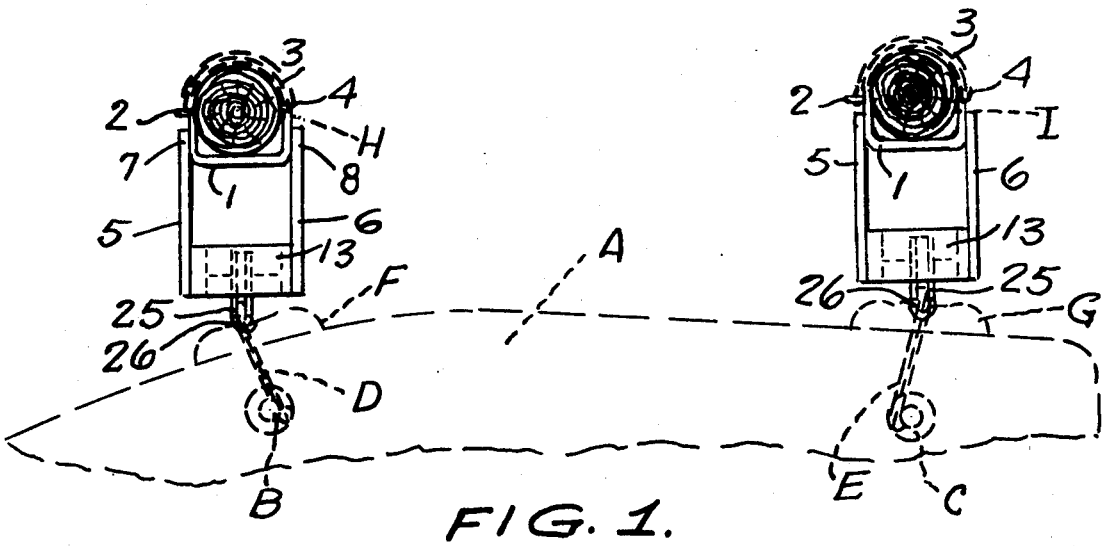
FIG. 1 is a top view of two piles having two of the present devices attached thereto and a boat, partially shown, connected to the two devices for mooring purposes.
Figure 2:
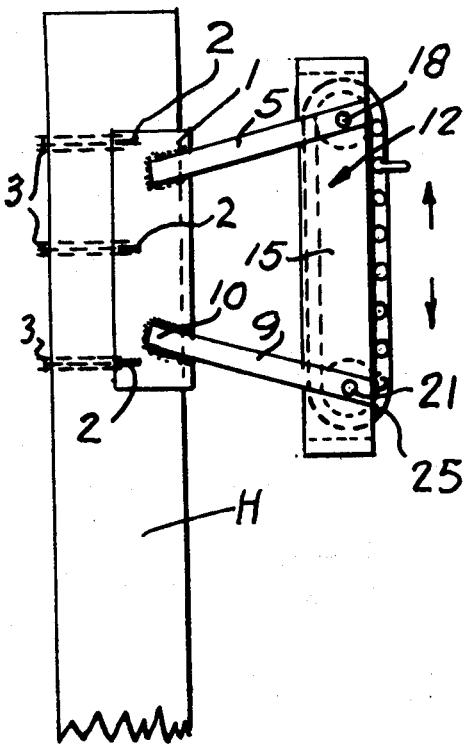
FIG. 2 is a side view of the present device attached to a pile which is partially shown.
Figure 3:
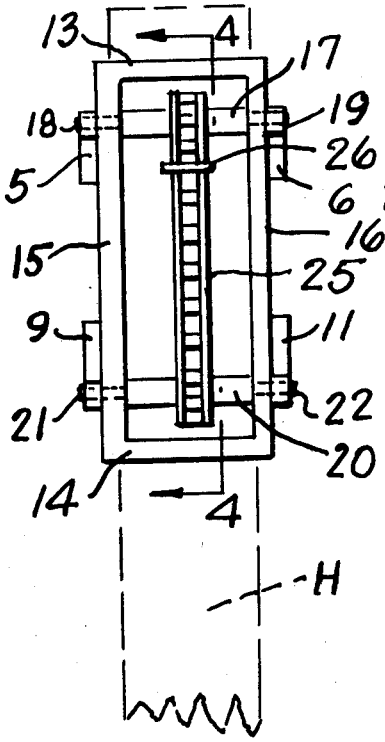
FIG. 3 is a front view of the present device with a pile indicated therebehind.
Figure 4:
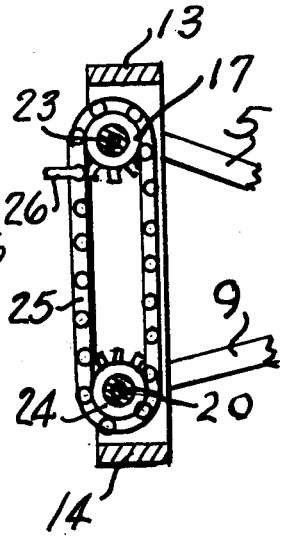
FIG. 4 is a sectional view taken on line 4—4 of FIG. 3.
Figure 5:
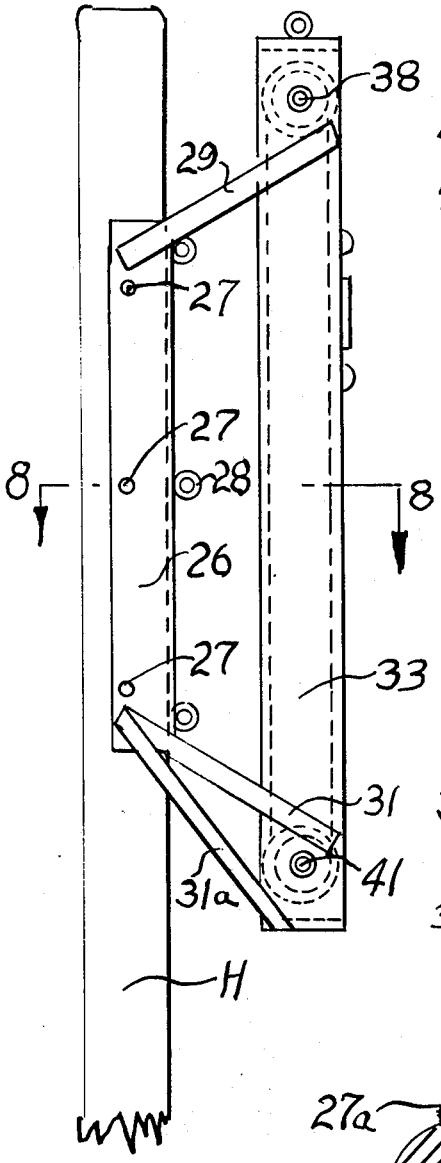
FIG. 5 is a side elevation of a modified form of the present device as mounted on a pile.
Figure 6:
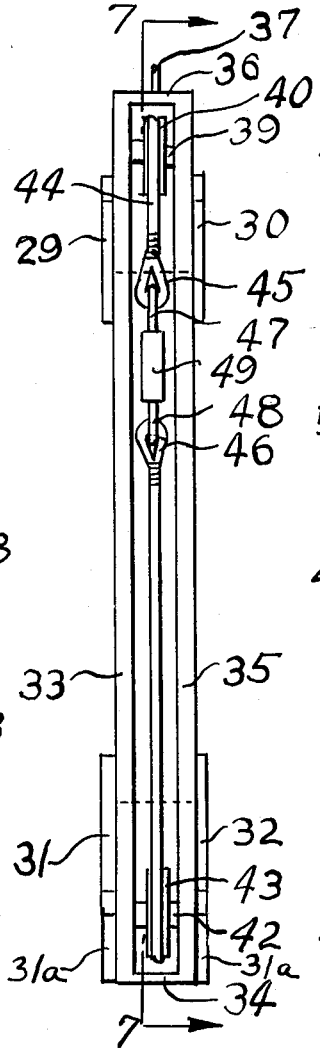
FIG. 6 is a front view of the device of FIG. 5.
Figure 7:
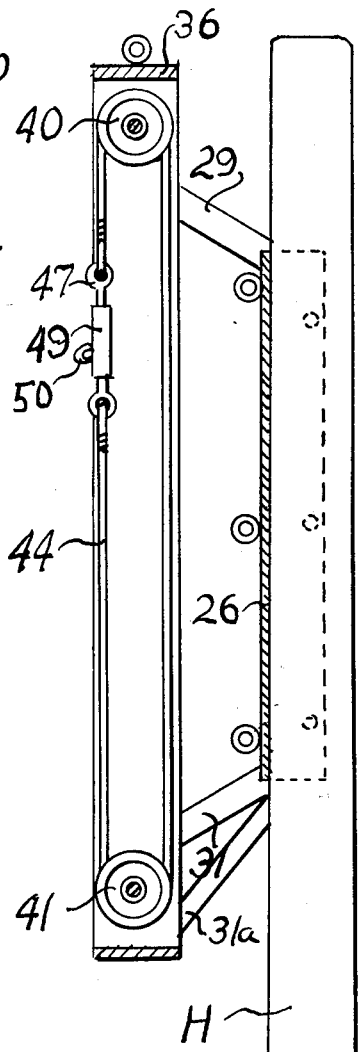
FIG. 7 is a longitudinal sectional view of the device taken on line 7—7 of FIG. 6, mounted on a pile.
Figure 8:
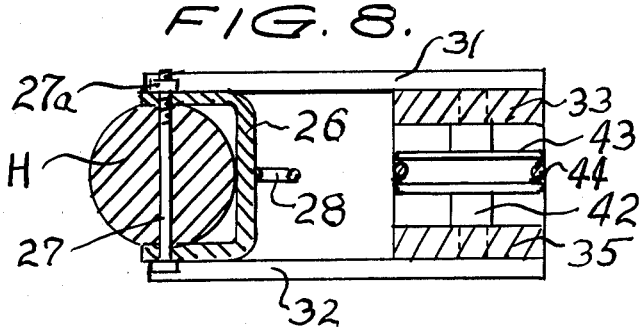
FIG. 8 is an enlarged cross-sectional view taken on line 8—8 of FIG. 5.

Referring now more in detail to the accompanying drawings in which like and corresponding parts are indicated by like reference characters and particularly FIGS. 1 to 4 thereof, A generally indicates the deck of a boat having a cleat or capstan B at its bow and a cleat or capstan C at its stern. A flexible connecting member D such as a rope, cable or chain is attached to cleat or capstan B and like wise a flexible connecting member E is attached to cleat or capstan C.

Fenders F and G are suspended alongside said boat for protection.

Piles H and I are embedded at one end in the bottom of a body of water and extend upright above the water. Piles are shown of wood, but merely represent conventional uprights such as wood or concrete piles, wharf supports or like members to which boats are moored.

In FIG. 1 two of the present mooring devices are shown, but as both devices are the same only one is now described in detail.

A plate 1 having a U-shaped section has eyes 2 attached thereto on one side and eyes 4 attached thereto on the opposite side with chains, cables or ropes 3 each attached to and extending between an eye 2 and its opposite eye 4, as shown.

Arm 5 is attached as by welding or bolts at end 7 to an upper end of a side of plate 1. Arm 6 is similarly attached at end 8 to the opposite upper end of the side of plate 1 opposite arm 5. Arm 9 is attached at 10 to the lower end of the same side of plate 1 as arm 5, by welding, bolts or the like and arm 11 also has an end similarly attached to the lower end of the same side of plate 1 as arm 6.

A rectangular casing 12 has a top 13, bottom 14, side 15 and a second side 16.

An axle 17 has stub shafts 18 and 19 extending through sides 15 and 16, respectively and the opposite ends of arms 5 and 6, respectively.

Axle 20 has stub shafts 21 and 22 extending through sides 15 and 16, respectively and the opposite ends of arms 9 and 11, respectively.

A sprocket 23 is rotatably mounted on axle 17 and sprocket 24 is rotatably mounted on axle 20. An endless link chain 25 extends around sprockets 23 and 24 and has an eye 26 attached to one link of said chain.

In the use of the present device, plate 1 is mounted against a side of a pile H or the like and each chain, cable or rope 3 is drawn taut and attached to opposite eyes 2 and 4 in conventional ways such as pins (not shown) in the case of chains, tieing in the case of ropes or clamps (not Shown ) in the case of cables.

Chains, ropes or cables D are attached to the cleats or capstans B of the boat A to be moored and to eye 26 by conventional means as used for members 3. Similarly flexible member E can be connected to an eye 26 of a second device on piling I and cleat or capstan C as shown in FIG. 1.

As indicated in FIG. 1 a plurality of the present devices can be used to moor the boat A when desired.

Thus when the boat A moves up and down with waves or changes in the tide, eye 26 moves therewith with chain 25 moving around sprockets 23 and 24.

Fenders F and G would slide along the front edges of sides 15 and 16 of casing 12, guiding and protecting the boat.

In the form of the present mooring device shown in FIGS. 1 to 4, casing 12 would have sides 15 and 16 each of between 4 to 6 feet long, three-eights of an inch thick by 7 inches wide. Plate 1 would be 4 to 6 feet long by 18 inches wide and three-eights of an inch thick. The top and bottom, 13 and 14 respectively, of casing 12 would each have a length the same as the width of plate 1 and three-eights of an inch thick by 7 inches wide. Arms 5, 6, 9 and 11 would each be three-eights of an inch thick by three inches wide and eighteen inches long. Axles 17 and 20 could each have a one inch diameter with 6 inch diameter sprockets 23 and 24 rotatable thereon. Chain 25 would be sized to mesh with and extend around sprockets 23 and 24. The elements would be of metal with casing 12, arms 5, 6, 9 and 11 and plate 1 preferrably of an aluminum alloy.

In FIGS. 5 to 8, there is shown a preferred form of the mooring device which has a U-shaped plate 26 to be attached by bolts 27 and nuts 27*a* on a side of a pile or the like H. Said plate 26 also has a series of eyes 28 attached thereto.

Arms 29, 30, 31 and 32 each have an end attached by welding or bolts to plate 26. Arms 29 and 30 extend upwardly from opposite sides of plate 26 while arms 31 and 32 extend downwardly from opposite sides of plate 26.

A rectangular open side casing has sides 33 and 35, bottom 34 and top 36. Arms 29 and 30 are attached to sides 33 and 35 respectively by welding or bolts while arms 31 and 32 are also similarly attached to sides 33 and 35, respectively.

An eye 37 is affixed to top 36.

An axle 38 extends through sides 33 and 35 while the hub 39 of a pulley 40 is rotatably mounted on said axle. Likewise a second axle 41 extends through sides 33 and 35, with hub 42 of a second pulley 43 being rotatably mounted on axle 41.

A flexible member 44 such as a cable or rope, has loops 45 and 46 at the opposite ends thereof. Eyes 47 and 48 have loops 45 and 46, respectively, extending therethrough. Each of said eyes 47 and 48 has a threaded leg in threaded engagement with the threaded bore of tube 49. The threads of the legs of eyes 47 and 48 extend in opposite directions and the bore of tube 49 has oppositely directed threads whereby the rotation of said tube will move eyes 45 and 46 towards or away from said tube adjusting the tautness of flexible member 44. Tube 49 also has an eye 50 on the side thereof.

Plate 26 could be 4 to 6 feet long, by 18 inches wide and three-eights of an inch thick.

The tops and bottom of casing 33–36 could be 18 inches wide, 7 inches deep and three-eights of an inch thick. Sides 33 and 35 could be 4 to 6 feet long, three-eights of an inch thick by 7 inches wide.

Arms 29–32 could each be three-eights of an inch thick by 3 inches wide and 18 inches long.

Axles 38 and 41 could each have a ¾ inch diameter with six inch pulleys 40 and 41 rotatable thereon. Flexible member 44 could be manilla, nylon or metal rope or cable. Preferrably the elements of the mooring device would be metal although other materials such as plastic are possible. Also the above measurements are given only as a preferred size, but other sizes could be also used.

In the use of the mooring device, plate 26 is placed against a side of pile H and bolts 27 are extended through two sides of plate 26 and pile H and affixed by nuts **27*a*** on the ends thereof.

A rope, cable or chain D or E or the like would be attached to eye 50 and a cleat or capstan B or C in the manner shown in FIG. 1 whereupon the boat A would be attached to pile H and eye 50 would ride up and down with said boat during changes in the level of the water supporting the boat.

Eyes 28 and 37 could be used for lifting the present device when desired.

A plurality of the devices 26–50 could be used in the manner suggested in FIG. 1.

Bars **31*a*** are safety devices at low tide of the water.

I claim:

1. Device for mooring a boat to an upright comprising a plate, means for attaching said plate to an upright, arms being fixedly attached to and extending from said plate an open side casing being fixedly supported by said arms lengthwise of said plate, a plurality of spaced apart axles extending between sides of said casing, annular members being rotatably mounted on said axles, a flexible member extending around said annular members, and means being connected to said flexible member and capable of attachment to the boat whereby said connected means would ride up and down with the boat.

2. Device as claimed in claim 1 wherein said casing is a rectangular open sided box.

3. Device for mooring a boat as claimed in claim 1 wherein said annular mambers are each a sprocket and said flexible member is an endless chain.

4. Device for mooring a boat as claimed in claim 1 wherein said annular members are each a pulley and said flexible member is an endless strand.

5. Device as claimed in claim 4 wherein said strand is a cable.

6. Device as claimed in claim 4 including means for adjusting the tautness of said strand.

7. Device as claimed in claim 4 including an eye attached to said strand.

* * * * *